United States Patent [19]

Geary

[11] Patent Number: 4,626,192

[45] Date of Patent: Dec. 2, 1986

[54] PRIMARY GAS FURNACE CONTROL

[75] Inventor: Frederick J. Geary, Holland, Mich.

[73] Assignee: Robertshaw Controls Company, Richmond, Va.

[21] Appl. No.: 627,038

[22] Filed: Jul. 2, 1984

[51] Int. Cl.[4] ..... F23Q 9/08

[52] U.S. Cl. ..... 431/46; 431/60; 431/74; 431/78

[58] Field of Search ..... 431/25, 46, 60, 74, 431/90, 78; 340/579

[56] References Cited

U.S. PATENT DOCUMENTS 3,766,441 10/1973 Gray ..... 431/6 X
4,070,143 1/1978 Dietz ..... 431/46 X
4,269,589 5/1981 Matthews ..... 431/46
4,435,150 3/1984 Rippelmeyer ..... 431/46

*Primary Examiner*—Randall L. Green
*Attorney, Agent, or Firm*—Candor, Candor & Tassone

[57] ABSTRACT

A primary gas furnace control including a thermostatically controlled intermittent ignition system, the control being effective to monitor and control main gas valve action through use of flame rectification. The control features a slight delay on main valve dropout with flame failure and an extension of the ignition source into the main burner cycle to prevent nuisance recycling. If desired, the control may also include timed pilot valve, thermostat resettable, lockout as well as prepurge capability for use in applications requiring a furnace combustion chamber purge prior to an ignition cycle.

5 Claims, 7 Drawing Figures

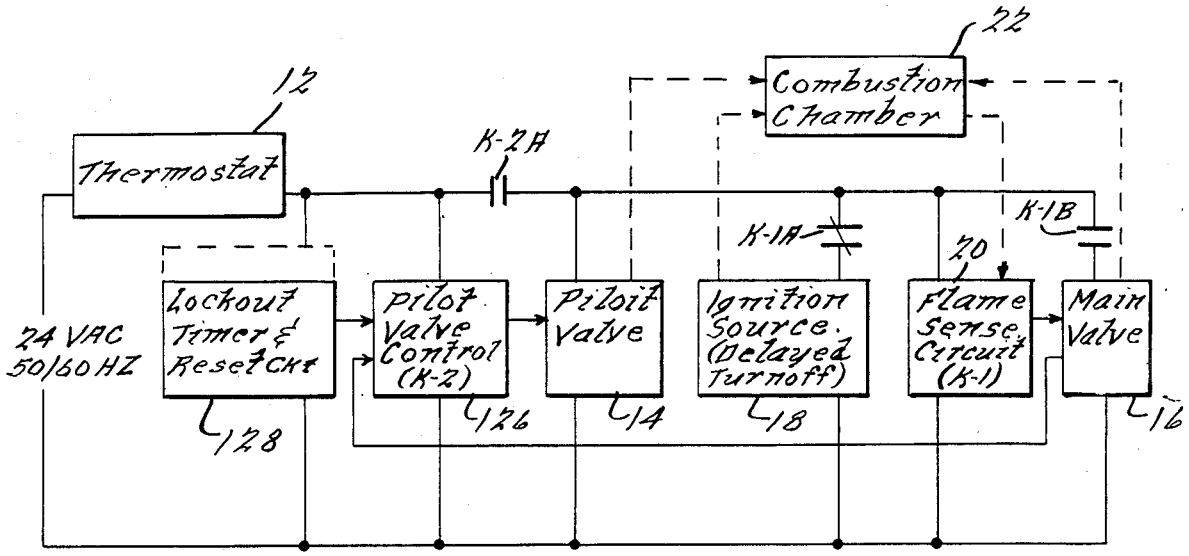
FIG. 3.
FIG. 7.
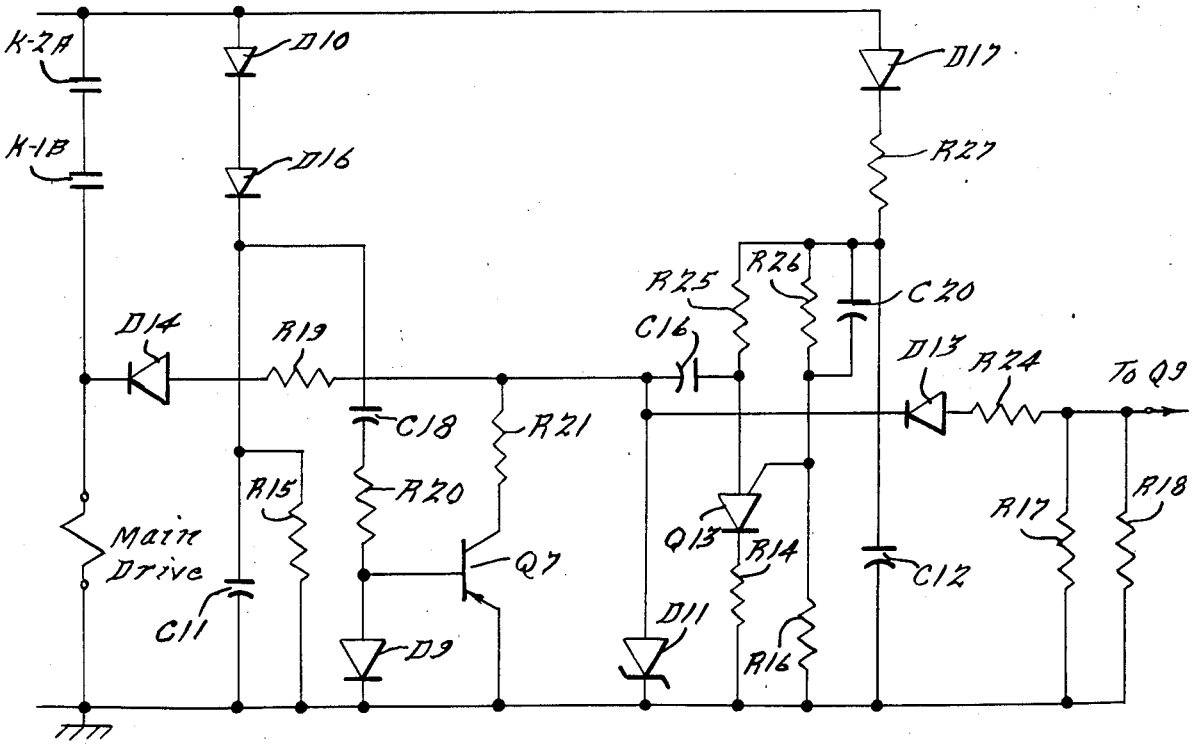

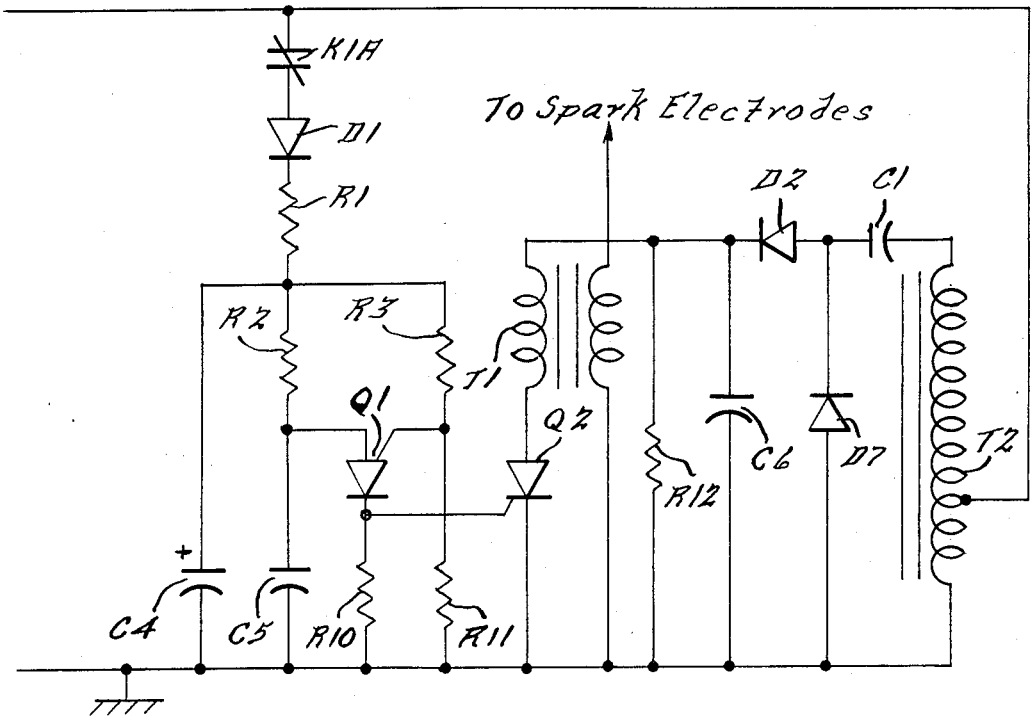
FIG. 5.
FIG. 6.
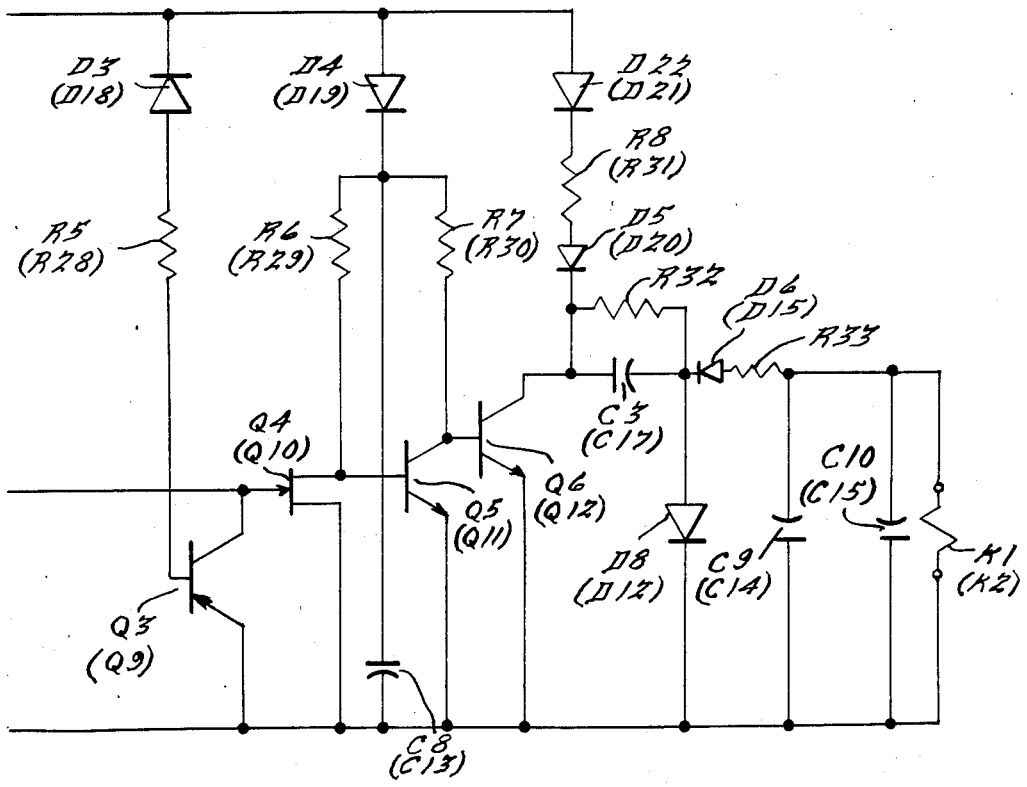

PRIMARY GAS FURNACE CONTROL

BRIEF SUMMARY OF THE INVENTION

This invention relates to primary controls for gas furnaces and, more particularly, to an improved primary gas furnace control incorporating unique means for controlling and monitoring main gas valve action through use of flame rectification.

Heretofore, primary gas furnace controls have been utilized for the purpose of controlling and supervising gas burners in furnaces, such primary controls being adapted to control the furnace burner in response to a low voltage thermostat which may be located in the living or occupied space of a dwelling or other structure, and supervising and controlling the furnace burner to insure safe combustion and to shut off the burner if an unsafe condition exists.

An object of the present invention is to overcome disadvantages in prior primary gas furnace controls of the indicated character and to provide an improved primary gas furnace control incorporating unique means for controlling and monitoring main gas valve action through the use of flame rectification.

Another object of the present invention is to provide an improved primary gas furnace control which incorporates a thermostatically controlled, intermittent ignition system and which may be adapted for use with natural gas and/or manufactured gas.

Another object of the present invention is to provide an improved gas furnace control incorporating improved means for preventing nuisance recycling on marginal furnace installations that could cause pilot flame separation from a sensing element incorporated therein.

Another object of the present invention is to provide an improved primary control for gas furnaces incorporating improved control circuitry which provides improved furnace burner control and supervision.

Another object of the present invention is to provide an improved primary gas furnace control having the capability of timed pilot gas valve, thermostat resettable lockout.

Another object of the present invention is to provide an improved primary gas furnace control incorporating improved means providing prepurge capability for use in applications, such as a power gas burner or other systems, requiring a combustion chamber purge prior to an ignition cycle.

Another object of the present invention is to provide an improved primary gas furnace control having thermostat resettable lockout capabilities.

Still another object of the present invention is to provide an improved primary gas furnace control which may be readily adapted to a wide variety of gas furnace applications and which is economical to manufacture and assemble and efficient and reliable in operation.

The above as well as other objects and advantages of the present invention will become apparent from the following description, the appended claims and the accompanying drawings.

BRIEF DESCRIPTION OF THE DRAWINGS

FIG. 3 is a schematic block diagram of another embodiment of the invention;

FIG. 5 is a schematic circuit diagram of the ignition source blocks illustrated in FIGS. 1 and 3 and incorporated in the circuits illustrated in FIGS. 2 and 4;

FIG. 6 is a schematic circuit diagram of the pilot/-main valve control blocks illustrated in FIGS. 1 and 3 and incorporated in the circuits illustrated in FIGS. 2 and 4; and FIG. 7 is a schematic circuit diagram of the lockout timer and reset circuit block illustrated in FIG. 3 and incorporated in the circuit illustrated in FIG. 4.

DETAILED DESCRIPTION

Figure 1:
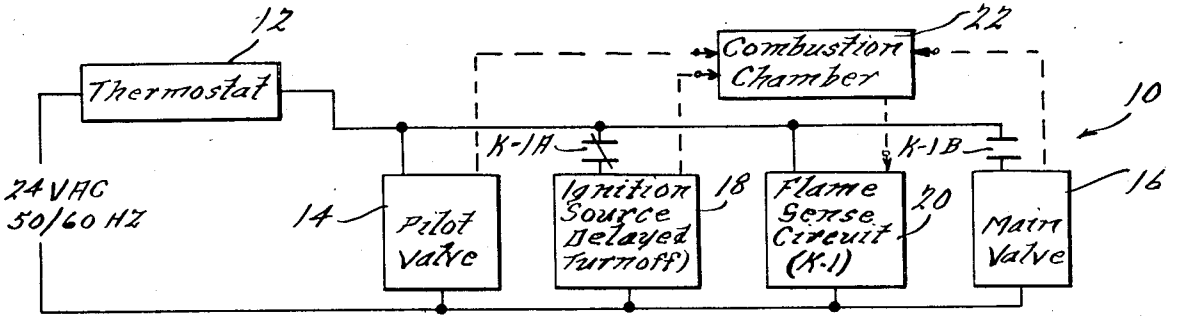
FIG. 1 is a schematic block diagram of a primary gas furnace control system embodying the present invention.

Referring to the drawings, and more particularly to FIG. 1 thereof, a schematic block diagram of a primary gas furnace control system, generally designated 10, embodying the present invention is illustrated therein. As shown in FIG. 1, the system 10 is comprised of a low voltage thermostat 12, pilot valve and main valve circuitry 14 and 16, respectively, ignition source circuitry 18, and a flame sense circuit 20, the ignition source circuitry 18 being adapted to initiate combustion of natural gas supplied to a combustion chamber 22 through the pilot and main valves.

Figure 2:
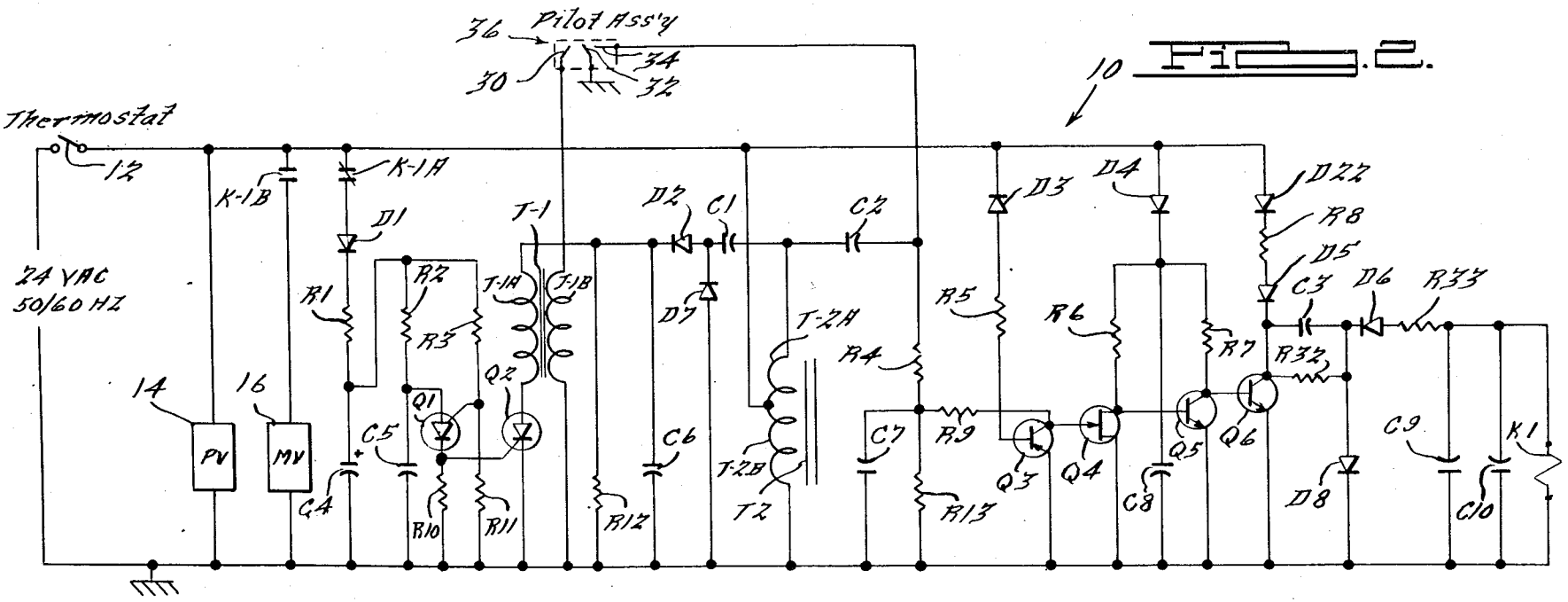
FIG. 2 is a schematic circuit diagram of the primary gas furnace control system illustrated in FIG. 1.

The primary gas furnace control system 10 embodying the invention illustrated in FIGS. 1 and 2 provides a thermostatically controlled, nonlockout, intermittent ignition system particularly adapted for use with natural gas, the system 10 controlling and monitoring main gas valve action through the use of flame rectification. The system 10 features a slight delay on main gas valve dropout with flame failure and an extension of the ignition source into the main burner cycle to prevent nuisance recycling on marginal furnace installations that could cause pilot flame separation from the sensing element. The system 10 is adapted to be connected to a source of 24 volt AC, 50/60 hertz current which may be supplied, for example, by any suitable means. Voltage is applied to the system 10 upon closure of the contacts of the thermostat 12, and upon closure of the contacts of the thermostat 12, the pilot gas valve 14 is opened thereby allowing pilot gas to flow to the combustion chamber 22. At the same time, the ignition source circuit 18 and the flame sense circuit 20 are activated, and spark discharges occur at electrodes 30 and 32 located in the combustion chamber 22, as for example at the rate of 5 spark discharges per second. Such spark discharges ignite the pilot gas, and the pilot flame impinges on a flame sensor 34 and causes flame rectification. The rectified signal is processed by the flame sense circuit and causes the relay K-1 to energize. Energization of the relay K-1 effects closure of normally open contacts K-1B provided on the relay K-1 and causes the main burner valve 16 to open, thereby permitting main burner combustion. Energization of the relay K-1 also effects the opening of normally closed contacts K-1A provided on the relay K-1 and removes voltage from the ignition source circuit 18. Due to a built-in delay, as will be described hereinafter in greater detail, the ignition source 18 continues to provide sparks at the electrodes 30 and 32, as for example for approximately four seconds, after the main gas valve 16 opens. This condition exists until the contacts of the thermostat 12 are opened. If for some reason, the gas supply is shut off during the cycle, the main gas valve 16 will close and the ignition source circuit 18 will be reactivated for attempted relighting of the pilot gas.

As shown in FIG. 2, the system 10 includes the thermostatic switch 12, the pilot gas valve 14, the main gas valve 16, resistors R1 through R13 and R32 and R33; diodes D1 through D8 and D22; capacitors C1 through C10; the relay K-1 having normally closed contacts K-1A and normally open contacts K-1B; transistors Q1 through Q6; a step up high voltage transformer T-1 having a primary winding T-1A and a secondary winding T-1B, the secondary winding T-1B being connected to the spaced electrodes 30 and 32 disposed in the combustion chamber 22 in the vicinity of the incoming gas which is to be ignited; and a step up auto transformer T-2 having windings T-2A and T-2B, the above described components being electrically connected by suitable conductors as illustrated in the drawings and as will be described hereinafter in greater detail.

The ignition source block 18 is comprised of two circuits, namely a pulse generator circuit and a spark generator circuit, the pulse generator circuit being utilized to trigger the spark generator circuit at a rate of, for example, 5 pulses per second over the specified operating voltage and temperature range. The spark generator is a diode clamped, capacitive discharge circuit which derives its voltage from a voltage doubler comprised of the capacitor C1, the capacitor C6, the diode D2 and the diode D7 fed by the step up auto transformer T-2. The output of the voltage doubler is coupled through the step up high voltage transformer T-1 to the electrode 30 incorporated in a pilot gas igniter assembly generally designated 36 which is disposed in the combustion chamber 22 and which also contains the sense electrode 34 which may be in the form of a wire probe formed of a suitable material capable of withstanding flame impinging thereon. The input voltage to the spark generator may be nominally rated at 24 volts AC. Depending upon the input voltage, the voltage ampere rating and tolerance, the actual input may range from 18 to 30 volts AC. This voltage is supplied to the auto transformer T-2 which steps up the voltage from approximately 93 to 125 volts AC in relation to the input, 113 volts AC being nominal. This transformed voltage is fed to the voltage doubler comprising the capacitor C1, the capacitor C6, the diode D2 and the diode D7 which approximately doubles the peak AC values of the input voltage and converts it to a DC voltage. It will be understood that the output of the auto transformer T-2 is not a pure sine wave and has slightly higher peak voltage than a root mean square conversion would indicate.

The peak voltage may be from 140 to 215 volts with 180 volts as the mean. The mean DC voltage is approximately 310 volts with a minimum of approximately 238 volts to a maximum of approximately 377 volts DC.

Discharge of the capacitor C6 through the primary winding of the high voltage transformer T-1 generates an exponentially decaying current pulse with a peak value of approximately 50 amperes, and a total duration of approximately six microseconds. The integrated value of the current is a rectangular pulse of approximately 23 amperes, the duration being approximately 6 microseconds.

The initial energy stored in the capacitor C6 is transformed by the transformer T-1 to supply or cause a voltage breakdown at the electrodes 30 and 32. It has been found that the gap will breakdown within approximately 1.2 microseconds of the initial discharge and remain on for the duration of the theoretical 6 microsecond rectangular pulse. The resistor R12 is a bleeder resistor connected across the capacitor C6 and permits the capacitor to discharge to 0 volts in approximately five seconds. The silicon controlled rectifier Q2 controls the flow of current through the primary winding of the transformer T-1.

The pulse generator is a relaxation programmable unijunction transistor oscillator, and as such is nonlatching and controls the application of current to the gate of the silicon controlled rectifier Q2. A timing capacitor C5 is provided which controls the discharge pulse into the gate of the silicon controlled rectifier Q2 while the resistor R10 is provided to avoid or reduce undesired firing of the silicon controlled rectifier Q2.

Gate current of the programmable unijunction transistor circuit is basically the current determined by the value of the gate to supply resistor R3. Since the pulse into the silicon controlled rectifier Q2 is an exponentially decaying pulse, the minimum initial capacitor voltage should be approximately 4 volts for worst case conditions. It is preferred that the pulse rate be approximately 5 pulses per second or one pulse every 200 milliseconds.

From the foregoing it should be understood that the ignition source circuitry as illustrated in FIGS. 2 and 5 includes the programmable unijunction transistor Q1, the silicon controlled rectifier Q2, the transformers T-1 and T-2, the diodes D1, D2 and D7, the capacitors C1, C4, C5 and C6, and the resistors R1, R2, R3, R10, R11 and R12, such components all being electrically connected as illustrated in FIGS. 2 and 5. The ignition source circuitry also includes the normally closed contacts K-1A of the relay K-1.

All parameters associated with the programmable unijunction transistor circuit are directly related to the programmable unijunction transistor gate current which is basically the current determined by the value of the gate to supply resistor R3. The circuit will oscillate at minus temperature/voltage extremes and not latch at high temperatures/voltage extremes. The resistor R11 is the other gate bias resistor. The filter capacitor C4 extends the pulsing into the main valve cycle after the relay K-1 removes voltage from the pulser, the nominal desired time being approximately four seconds.

The valve control circuitry is illustrated in FIGS. 2 and 6, and this circuit operates on the principle of energy transfer. On one half cycle the capacitor C3 charges to a predetermined voltage. On the next half cycle, the capacitor C3 discharges into the relay K-1 and the sustaining capacitors C9 and C10 connected across the relay coil. The energy imparted from the discharge capacitor into the relay and sustaining capacitors C9 and C10 must be great enough to pull in and hold the relay until the next discharge cycle. In order to prevent relay chatter from occurring, in the embodiment of the invention illustrated in FIGS. 2 and 6, the two sustaining capacitors C9 and C10 are provided across the relay coil so that if one opens, the other will sustain the relay. The capacity of the discharge capacitor C3 is preferably chosen so that the energy level is almost constant.

The transistor Q6 is a switching transistor and the value of the resistor R7 is chosen to allow the transistor Q5 to have a gain of ten to one to insure saturation. The time constant of the minimum values of the resistors R6 and R7 in parallel and the minimum capacitance must be one line cycle which at 50 hertz is 20 milliseconds. With respect to the capacitor C8, the worst case power dissipation for the resistors R6 and R7 occurs at their minimum tolerances and at maximum capacitance for the capacitor C8. The maximum driving current into the base of the transistor Q6 is exponentially decaying current which is more than adequate to discharge the capacitor C3 into the relay K-1.

The transistor Q4 is a field effect transistor and the pinch off voltage is preferably between 2.5 and 4.5 volts. The gate source breakdown voltage is minus 30 volts DC while the drain source breakdown voltage is 30 volts DC. The transistor Q5 is a driver transistor while the transistor Q3 is a PNP field effect switching transistor, the base being driven by the line voltage through the diode D3 and the resistor R5. When this circuit is used for the main valve, a bleeder resistor R32 is included across the discharge capacitor C3 to eliminate a momentary pulse to the main valve on thermostat reset. Such a pulse, although too short to release gas, could increase valve wear and shorten the life of the valve. As will be described hereinafter in greater detail, the foregoing circuit is used for both the pilot and main valve controls in the embodiment of the invention illustrated in FIGS. 3 and 4, the components in parenthesis in FIG. 6 being in the pilot valve circuit illustrated in FIGS. 3 and 4.

In each of the embodiments of the invention illustrated, flame rectification is used to sense the presence of flame. Flame rectification can be thought of as the flame simulating a high resistance diode with high leakage current, parallel by a small capacitor. In the embodiments of the invention illustrated, flame rectification will cause main valve pull in in a predetermined period of time, such as approximately 13 seconds, this being due to an effect similar to an R-C time constant of the flame sensor. Upon initial flame impingement on the sensor 34, the output voltage is high, then swiftly drops to a low level for a few seconds and then gradually climbs to a high level. The resistor R4 in the flame sense circuit is made large enough to prevent initial high voltage from immediately appearing across the C7 to allow valve pull in and then allowing valve drop out as the sensed voltage decreases.

With a power on, gas interruption, a certain time elapses before the system can recognize and react to reestablish flame. This time must be specified as a maximum time even if there have been up to and including two component failures that were not manifest as control debilitating failures. In the embodiment of the invention illustrated, flame sensing is accomplished by flame rectification, whereby the sensor probe 34 in the presence of a flame causes a negative voltage to be impressed across the capacitor C7. This negative voltage is supplied through the resistor R9 to the gate of the field effect transistor Q3 which controls the main valve. The field effect transistor draws minuscule current so a method to discharge the capacitor C7 in the event of flame failure is provided to establish a time period for recognition of flame loss. There are two such paths. One is through the series resistor R9 and the transistor Q3 to ground. It will be understood that the transistor Q3 is turned on every half cycle, and the capacitor C7 is allowed to discharge through this path at approximately one half the normal rate. The second discharge path is through the resistor R13 to ground. If the resistor R9 or the transistor Q3 are open or short, the circuit is immediately disabled, as it is if the resistor R13 shorts. If the resistor R13 opens, the discharge time of the capacitor C7 increases. Therefore, the maximum flame reestablishment time must be defined with the resistor R13 being considered removed from the circuit. The field effect transistor Q4 pinch off voltage is preferably selected to obtain the desired flame reestablishment time, such pinch off voltage being correlated also with the temperature of the sense probe.

When pilot flame is established and the flame sense circuit allows the main valve to open, the turbulence generated by main burner ignition may be severe enough to divert the pilot flame from the sensor 34. Such a situation could cause cycling of the cycle by allowing main valve drop out. In order to prevent main valve drop out, the capacitor C7 is not allowed to discharge too quickly. The capacitors C2 and C7 in the flame sense network are preferably selected to have a 10 to 1 ratio to prevent AC voltage from exceeding the field effect transistor Q4 maximum gate voltage in the event the resistor R4 shorts. The resistor R4 is selected to be one time constant at one half cycle. Since part of the discharge path of the capacitor C7 is through the transistor Q3, the discharge time is influenced by the amount of time the transistor Q3 conducts. If the resistor R13 is removed from the circuit, the resistor R9 and the transistor Q3 are the only discharge paths. Since the transistor Q3 is only conducting for part of a half cycle, the resistor R9 acts as a much larger resistor than its value would indicate.

The method for deriving time involves using alternate resistors for each half cycle. Since the transistor Q3 conducts only for milliseconds, the capacitor C7 will discharge through the parallel combination of the resistor R13 and the resistor R9 during this time.

Another embodiment of the invention is illustrated in FIGS. 3, 4, 5, 6 and 7 and is composed of a primary gas furnace control system, generally designated 100. This embodiment of the invention is an extension of the embodiment of the invention illustrated in FIGS. 1 and 2 with the features mentioned hereinabove but with the additional capabilities of timed pilot valve, theremostat resettable lockout and is intended for use with both natural gas and manufactured gas. This embodiment of the invention also includes, if desired, a prepurge capability for use in applications such as power gas burner or other systems requiring a combustion chamber purge before an ignition cycle. The system 100 includes the thermostat 12, pilot valve circuitry 14, main valve circuitry 16, ignition source circuitry 18 and flame sense circuitry 20. In addition, the system 100 includes pilot valve control circuitry 126 and lockout timer and reset circuitry 128. Thus this embodiment of the invention includes the circuitry of the embodiment of the invention illustrated in FIGS. 1 and 2 and also includes additional circuitry to control the action of the pilot valve to provide prepurge, postpurge (lockout), and reset functions. This additional circuitry may be divided into two main functional circuits, the pre/postpurge timer and reset circuit, and the pilot valve control circuit. The valve control circuit for the pilot valve is identical to the valve control circuit for the main gas valve previously described and the description thereof is equally applicable to this embodiment of the invention, the identification of the components of this embodiment of the invention in FIG. 6 being enclosed in parenthesis. This embodiment of the invention has thermostat resettable lockout capabilities which requires the thermostat contacts to be opened for a minimum of one second. If the thermostat is opened during the ignition trial period and reclosed the timing circuit for lockout will reset to zero and recommence timing for the specified maximum lockout time. With the addition of prepurge capability, this embodiment of the invention will recycle to the beginning of the prepurge mode anytime the thermostat is open for a period of one second or greater. The pre/-postpurge circuit is capable of providing a prepurge timing from approximately 1.3 to approximately 45 seconds, and a post or lockout time up to approximately 90 seconds with a one second reset capability. Prepurge time is determined by a capacitor C16 and a resistor R25 while lockout time is determined by the capacitor C16 and a resistor R24, allowing various combinations of timings to be specified as desired. The reset circuit is a redundant pair that causes reset back to prepurge or start-up upon removal of line voltage. Thermostat twiddle or valve shorting, being a form of line voltage interruption, will cause reset.

The prepurge/lockout and timer reset circuitry is illustrated in FIG. 7. This circuit utilizes a programmable unijunction transistor as does the pulse generator previously described. However, unlike the pulse generator circuit previously described, this is a latching circuit, and when the programmable unijunction transistor Q13 once triggers, it may not trigger again as long as voltage is applied. The prepurge timing is accomplished by charging the capacitor C16 through the resistor R25 to the trigger voltage of the programmable unijunction transistor Q13. The postpurge timing is achieved by discharging the capacitor C16 through the resistor R24 into the gate of the transistor Q10 which is modulated by the transistor Q9 and clamped by the zener diode D11 to give consistent timing over the applicable voltage range. The prepurge maximum time may be specified, for example, to be approximately 45 seconds, while the maximum postpurge time may be specified, for example, to be approximately 60 seconds. Any combination of times within these limits may be achieved by changing the values of the resistor R25, the capacitor C16 and/or the resistor R24 and the zener diode D11. For example, the value of the resistor R25 may be reduced for shorter timing, or shorter timing may be accomplished by retaining the value of the resistor R25 and reducing the size of the capacitor C16. Thus the values of the capacitor C16 and the resistor R25 are chosen based upon the desired time constant to trigger the programmable unijunction transistor, thus ending the timing cycle.

Postpurge, or lockout timing, is accomplished by discharging the capacitor C16 through the resistor R24 thereby placing a negative voltage on the gate of the transistor Q10 in the pilot valve control circuit. The capacitor C16 charges to the trigger voltage through the zener diode D11 which although a zener diode acts as a conventional diode during the charging of the capacitor C16. When the capacitor C16 reaches the trigger voltage of the transistor Q13 triggers and because of the resistor R25 latches. The capacitor C16 can only discharge to the zener voltage of the zener diode D11 through the transistor Q13. It is then clamped to the zener voltage and its only discharge path is through the resistor R24 and the transistor Q9, and the parallel combination of the resistors R17 and R18. The resistors R17 and R18 are gate to ground resistors for the transistor 10 to protect against stray voltage pickup that could affect lockout timing. They are redundant resistors, and if one resistor should open, timing would increase by a very small percentage.

The predominant discharge path for the capacitor C16 is through the resistor R24 and the transistor Q9. On each negative half cycle the transistor Q9 is driven into saturation effectively grounding both the gate of the transistor Q10 and the resistor R24 thereby allowing the capacitor C16 to discharge for that half cycle or a portion thereof until the voltage of the capacitor C16 is less than the pinchoff voltage of the transistor Q10 at which time the pilot valve relay K-2 drops out thereby causing lockout. Temperature and line voltage have only a very small effect on lockout timing.

The reset portion of the circuit is redundant with two reset mechanisms. With the application of line voltage, the capacitors C18 and C19 charge through the diodes D9 and D10. Removal of line voltage causes the capacitors C18 and C19 to discharge through the transistors Q7 and Q8 causing the capacitor C16 to discharge, resetting the timer to prepurge or prelockout. The capacitor C20 is a third backup for reset, forcing the gate of the transistor Q13 high on application of voltage, overriding the latchup resistor R26. The resistor R27 protects the diode D17 from surge currents and the capacitor C12 is a filter capacitor.

Figure 4:
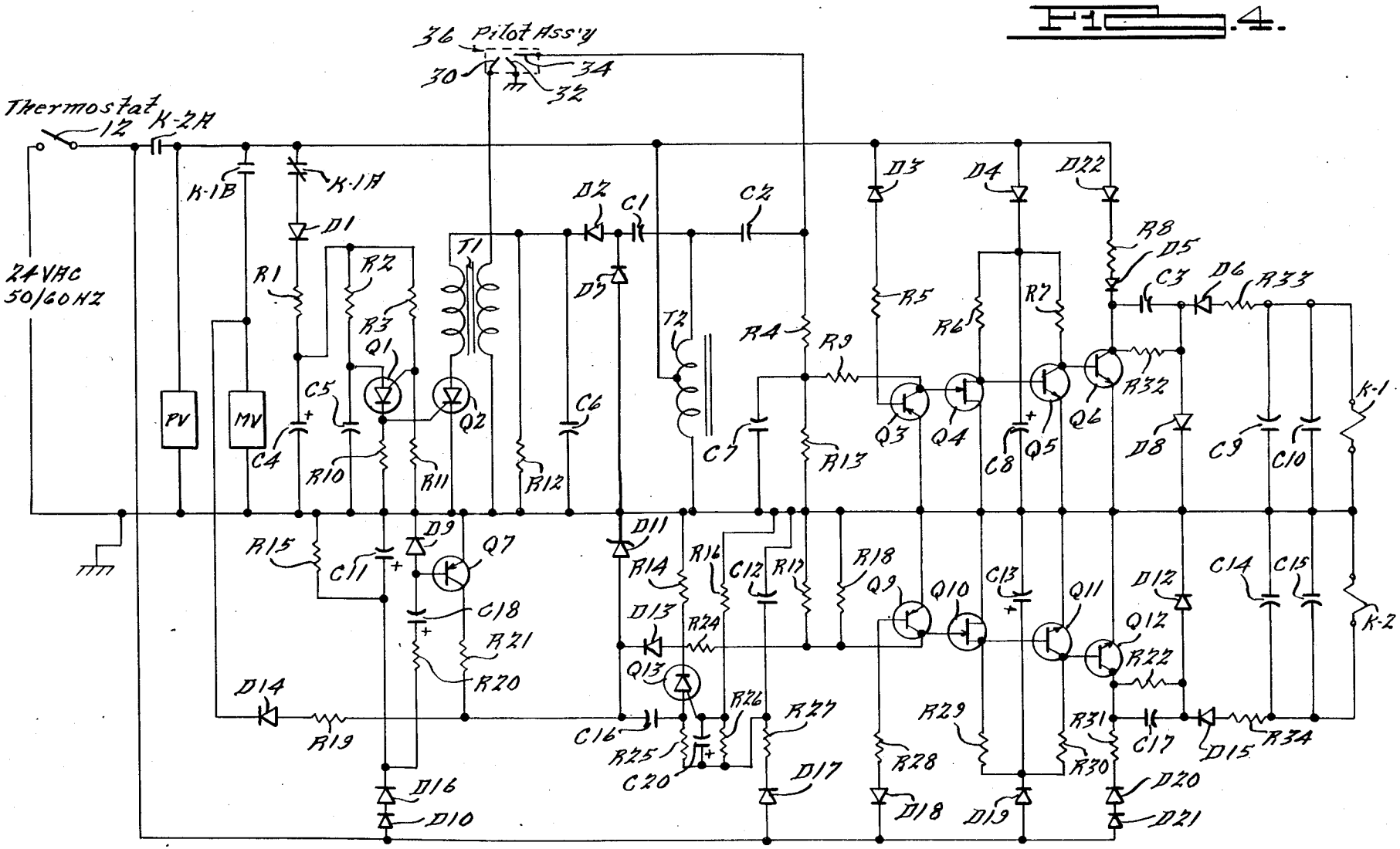
FIG. 4 is a schematic circuit diagram of the embodiment of the invention illustrated in FIG. 3.

From the foregoing it will be appreciated that the embodiment of the invention illustrated in FIGS. 1 and 2 provides a thermostatically controlled, nonlockout, intermittent ignition system which is particularly adapted for use with natural gas and which controls and monitors main valve action through the use of flame rectification. Such embodiment of the invention features a slight delay on main valve dropout with flame failure and an extension of the ignition source into the main burner cycle to prevent nuisance recycling on marginal furnace installations that could cause pilot flame separation from the sensing element. The embodiment of the invention illustrated in FIGS. 3 and 4 is an extension of the embodiment of the invention illustrated in FIGS. 1 and 2 with all of the capabilities mentioned above, but with the additional capability of timed pilot valve, thermostat resettable, lockout. This embodiment of the invention is particularly adapted for use with both natural and manufactured gas. The embodiment of the invention illustrated in FIGS. 3 and 4 also includes prepurge capability for use in applications such as a power gas burner or other systems requiring a combustion chamber purge before an ignition cycle. This embodiment of the invention has thermostat resettable lockout capabilities, this feature requiring the thermostat to be opened for a minimum of approximately one second. In the embodiment of the invention illustrated in FIGS. 3 and 4, if the thermostat is opened during the ignition trial period and reclosed, the timing circuit for lockout time will reset to zero and recommence timing to the specified maximum lockout time. In the embodiment of the invention illustrated in FIGS. 3 and 4, the control will recycle to the beginning of the prepurge mode anytime the thermostat is opened for a period of approximately one second or greater.

In the operation of the embodiment of the invention illustrated in FIGS. 1 and 2, voltage is applied to the circuitry on thermostat contact closure. The pilot valve 14 is opened allowing pilot gas to flow and both the flame sense circuit previously described and the ignition source circuit previously described are activated. Spark discharges occur at the electrodes 30 and 32 in the combustion chamber 22 at a rate, for example, of five per second. These discharges ignite the pilot gas. The pilot gas impinges on the flame sensor 34 and causes flame rectification, and the rectified signal is processed by the flame sense circuit and thereby causes the relay K-1 to energize. Energization of the relay K-1 causes closure of the normally open contacts K-1B of the relay thereby causing the main burner valve to open, allowing main burner combustion, and removes voltage from the ignition source circuit by opening the normally closed contacts K-1A. Due to the built-in delay previously described, the ignition source continues to spark for approximately four seconds after the main valve opens. This condition exists until the thermostat is opened. If for some reason the gas supply is cut off during the cycle, the main valve will close and the ignition source circuit reactivates for attempted relight.

In the operation of the embodiment of the invention illustrated in FIGS. 3 and 4, voltage is also applied to the circuit on thermostat contact closure. The timer/reset circuitry illustrated in FIGS. 4 and 7 is activated, and after approximately four seconds on a nonprepurge version or within approximately 45 seconds on a prepurge version, the pilot valve control circuit is activated in a time out mode, thereby causing the relay K-2 to energize. Activation of the relay K-2 effects closure of the normally open contacts K-2A thereby causing the pilot valve to open and ignition sparking to commence in the manner previously described. Pilot flame is established and sensed as described hereinabove, and main burner combustion occurs. Voltage is fed back to the pilot valve control circuit from the main valve to negate lockout timing. If during this sequence, pilot flame is not established, the main valve will not be energized, and after a specified time the pilot valve control circuit will deactivate thereby stopping ignition attempts and pilot gas flow. This lockout condition will continue indefinitely until the thermostat is opened. Closing the thermostat will then cause the sequence to repeat.

During any portion of the cycle described hereinabove, if the thermostat is opened for a period of time greater than approximately one second, the reset circuitry will cause the control to recycle to the beginning of the prepurge or lockout timing cycle. A power on, gas interruption will cause the control to attempt reignition for a period of time equal to the normal lockout time. If reignition does not occur, lockout will occur. For this event, prepurge is not affected.

Typical values and descriptions of the components of the embodiments of the invention illustrated in the drawings and described hereinabove are as follows:

R1 120 ohms
R2 2 M ohms
R3 22 K ohms
R4 4.7 M ohms
R5 2.2 K ohms
R6 39 K ohms
R7 4.3 K ohms
R8 79 ohms
R9 4.7 M ohms
R10 120 ohms
R11 33 K ohms
R12 1 M ohms
R13 22 M ohms
R14 120 ohms
R15 180 K ohms
R16 4.3 M ohms
R17 10 M ohms
R18 10 M ohms
R19 470 ohms
R20 33 K ohms
R21 120 ohms
R22 5.6 K ohms
R24 150 K ohms
R25 47 K ohms
R26 2.7 M ohms
R27 120 ohms
R28 2.2 K ohms
R29 39 K ohms
R30 4.3 K ohms
R31 79 ohms
R32 5.6 K ohms
R33 33 ohms
R34 33 ohms

D1 IN4004
D2 IN4004
D3 IN4148
D4 IN4004
D5 IN4004
D6 IN4148
D7 IN4004
D8 IN4148
D9 IN4148
D10 IN4004
D11 IN5246 B
D12 IN4148
D13 IN4148
D14 IN4004
D15 IN4148
D16 IN4004
D17 IN4004
D18 IN4148
D19 IN4004
D20 IN4004
D21 IN4004
D22 IN4004

Q1 2 N6028
Q2 MCR-22 -6
Q3 2 N2907
Q4 2 N5639
Q5 2 N2222 A
Q6 MPS-W-01 A
Q7 2 N2907
Q9 2 N2907
Q10 2 N5639
Q11 2 N2222 A
Q12 MPS-W-01 A
Q13 2 N6028

C1 0.15 Mfd: 250 V
C2 0.0068 Mfd: 400 V
C3 47 Mfd: 35 V
C4 6.8 Mfd: 50 V
C5 0.1 Mfd: 100 V
C6 0.47 Mfd: 400 V
C7 0.068 Mfd: 250 V
C8 10 Mfd: 50 V
C9 6.8 Mfd: 50 V
C10 6.8 Mfd: 50 V
C11 6.8 Mfd: 50 V
C12 2.2 Mfd: 50 V

C13 10 Mfd: 50 V
C14 6.8 Mfd: 50 V
C15 6.8 Mfd: 50 V
C16 100 Mfd: 35 V
C17 47 Mfd: 35 V
C18 6.8 Mfd: 50 V
C20 6.8 Mfd: 50 V

It will be understood however that these values may be varied depending upon the particular application of the principles of the present invention.

While preferred embodiments of the invention have been illustrated and described, it will be understood that various changes and modifications may be made without departing from the spirit of the invention.

What is claimed is:

1. In a primary control for gas furnaces, and comprising a low voltage circuit adapted to be connected to a source of low voltage AC current, said low voltage circuit having a thermostatic switch therein, an electrically operable pilot gas valve therein, an electrically operable main gas valve therein, relay means therein for controlling the energization of said main gas valve when a coil of said relay means is energized by a main valve control circuit portion of said low voltage circuit, and flame sensing means therein and disposed so as to be in the path of gas emanating from said pilot gas valve and being subjected to the heat of the gas flame thereof when said gas has been ignited, said flame sensing means having means for controlling said main gas valve by effecting the energization of said coil of said relay means when said flame sensing means is sensing the presence of said gas flame, the improvement wherein said main valve control circuit portion has discharge capacitor means controlling the energization of said coil and has sustaining capacitor means connected in parallel with said coil and effective to maintain energization of said coil during recharging of said discharge capacitor means.

2. A primary control as set forth in claim 1 wherein said flame sensing means comprises a probe disposed so as to be in said path of said gas emanating from said pilot gas valve.

3. A primary control as set forth in claim 1 and further comprising a high voltage spark generating circuit comprising spaced electrodes disposed so as to be in said path of said gas emanating from said pilot valve for igniting said gas when said spark generating circuit is activated to cause sparking between said electrodes thereof.

4. A primary control as set forth in claim 3 and further comprising a step up high voltage transformer having a primary winding disposed in said low voltage circuit and a secondary winding disposed in said spark generating circuit whereby said low voltage circuit is adapted to activated said spark generating circuit through said transformer.

5. A primary control as set forth in claim 1 wherein said electrically operable pilot gas valve and said electrically operable main gas valve are disposed in parallel in said circuit.

* * * * *